US009181077B2

(12) United States Patent
Lee et al.

(10) Patent No.: US 9,181,077 B2
(45) Date of Patent: Nov. 10, 2015

(54) METHODS FOR LIQUEFIED NATURAL GAS FUELING

(71) Applicants: Ron C. Lee, Bloomsbury, NJ (US); Paul Jarrett, Leeds (GB); Stephen Foster, Birchgrove (AU)

(72) Inventors: Ron C. Lee, Bloomsbury, NJ (US); Paul Jarrett, Leeds (GB); Stephen Foster, Birchgrove (AU)

(73) Assignee: LINDE AKTIENGESELLSCHAFT, Munich (DE)

( * ) Notice: Subject to any disclaimer, the term of this patent is extended or adjusted under 35 U.S.C. 154(b) by 236 days.

(21) Appl. No.: 13/746,380

(22) Filed: Jan. 22, 2013

(65) Prior Publication Data

US 2014/0202583 A1 Jul. 24, 2014

(51) Int. Cl.

| | |
|---|---|
| ***B67D 7/04*** | (2010.01) |
| ***F17C 5/02*** | (2006.01) |
| ***F17C 5/04*** | (2006.01) |

(52) U.S. Cl.

CPC ... *B67D 7/04* (2013.01); *F17C 5/02* (2013.01); *F17C 5/04* (2013.01); *F17C 2201/0109* (2013.01); *F17C 2201/0119* (2013.01); *F17C 2205/0165* (2013.01); *F17C 2205/0323* (2013.01); *F17C 2221/033* (2013.01); *F17C 2223/0161* (2013.01); *F17C 2223/047* (2013.01); *F17C 2227/0121* (2013.01)

(58) Field of Classification Search

USPC ..... 141/2, 11, 59, 82, 285; 62/50.1

See application file for complete search history.

(56) References Cited

U.S. PATENT DOCUMENTS

| | | | | |
|---|---|---|---|---|
| 3,763,901 | A * | 10/1973 | Viland | 141/8 |
| 4,059,424 | A * | 11/1977 | Bentz | 62/49.2 |
| 5,121,609 | A * | 6/1992 | Cieslukowski | 62/50.4 |
| 5,228,295 | A | 7/1993 | Gustafson | |
| 5,315,831 | A * | 5/1994 | Goode et al. | 62/611 |
| 5,549,142 | A * | 8/1996 | Beale | 141/49 |
| 6,044,647 | A * | 4/2000 | Drube et al. | 62/50.1 |
| 7,721,557 | B1 * | 5/2010 | Stearns | 62/48.2 |
| 2010/0096039 | A1 * | 4/2010 | Midttun | 141/11 |

* cited by examiner

*Primary Examiner* — Timothy L Maust

(74) *Attorney, Agent, or Firm* — Philip H. Von Neida

(57) ABSTRACT

A method and apparatus for fueling the onboard storage tank of a vehicle with liquefied natural gas. A liquid cryogen such as liquid nitrogen is fed to a condensing unit to condense natural gas present in a fueling system. Liquefied natural gas is fed into the fueling system and natural gas vapor is recovered from the onboard storage tank of the vehicle and fed to the condensing unit. When the pressure of the onboard storage tanks is sufficient, the liquefied natural gas is fed from the fueling system to the onboard storage tanks.

8 Claims, 1 Drawing Sheet

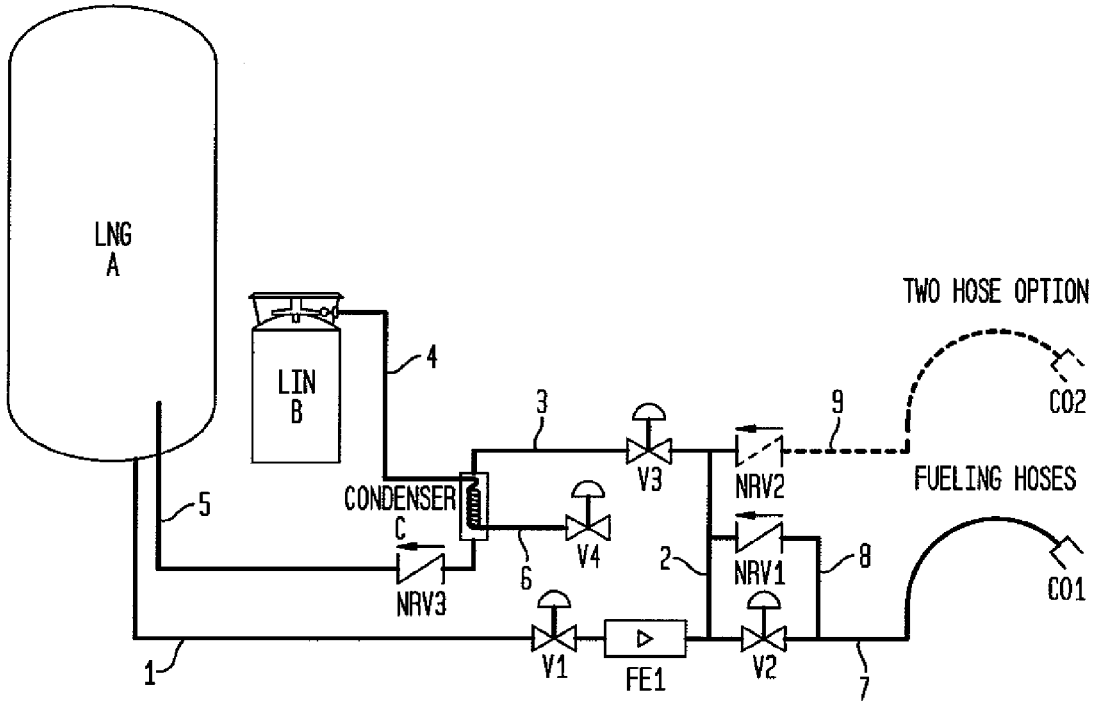
LNG
A
LIN
B
4
3
V3
9
TWO HOSE OPTION
CO2
NRV2
FUELING HOSES
5
CONDENSER
C
V4
6
2
NRV1
8
CO1
NRV3
V1
FE1
V2
1
7

METHODS FOR LIQUEFIED NATURAL GAS FUELING

BACKGROUND OF THE INVENTION

The invention provides for a method of fueling the onboard storage tanks of a vehicle powered by natural gas.

Liquefied natural gas (LNG) fueling for vehicles typically use either a pump or a pressure decant approach. For a pumped system, the LNG bulk storage tank can be maintained at a pressure below that of the onboard tank to be fueled. However, in the pressure decant method, the LNG bulk storage tank is maintained at a pressure significantly higher than the onboard fuel tank. For example, a bulk storage tank for pressure decant may be maintained at 15 barg in order to fuel an onboard storage tank at about 8 barg. This poses a problem when the onboard tank contains vapor or vapor generated during the fueling process which must be returned to the bulk storage tank as condensed liquid. For a pumped system, the vapor can be routed and introduced directly into the bottom of the bulk storage tank where it may be condensed by cold bulk liquid. This is not possible with a pressure decant system, so vapor is often vented to the atmosphere. This practice can result in both economic and environmental inefficiencies.

The LNG fueling process is a periodic process which may operate for only a few minutes with extended time between fueling operations. With a pumped system, it is possible to pre-cool the fueling equipment by circulating liquid through the fueling equipment (e.g., flow meter) prior to fueling. This is not possible with a pressure decant system which can lead to excessive venting and slow fueling.

SUMMARY OF THE INVENTION

In a first embodiment of the invention, there is disclosed a method for fueling a vehicle comprising the steps:

a) Feeding a liquid cryogen into a condensing unit, thereby condensing natural gas present in the condensing unit;
b) Recovering natural gas vapor from an onboard storage tank of the vehicle and feeding the natural gas vapor to the condensing unit; and
c) Feeding liquefied natural gas from a fueling system to the onboard storage tank.

The liquid cryogen is typically liquid nitrogen. The introduction of the liquid cryogen into the condensing unit will help create a pressure differential between the onboard storage tanks to be filled and the bulk liquefied natural gas storage tank of the fueling system. This pressure differential will allow the liquefied natural gas to flow through the fueling system.

The components of the fueling system are typically valves, flow meters and pipes and when the system is not operating, they become warm. The flow of the liquefied natural gas through the fueling system will cool these components down to provide for better operation of the fueling system.

The recovery of the natural gas vapor and its feed to the condensing unit will continue until an appropriate predetermined pressure is reached in the onboard storage tanks of the vehicle that is to be fueled. When this pressure is reached, the fueling apparatus can begin dispensing liquefied natural gas into the onboard storage tanks.

The liquefied natural gas is fed to the onboard storage tank through a hose and more than one hose may be present in the fueling system.

The natural gas vapor that is fed to the condensing unit will be fed back to the bulk liquefied natural gas storage tank after fueling of the onboard storage tanks is finished.

In a further embodiment of the invention there is disclosed an apparatus for fueling a vehicle comprising a bulk liquefied natural gas storage tank in fluid communication with a hose and also with a condensing unit, and a liquid cryogen tank in fluid communication with the condensing unit.

A flow meter can be placed between the bulk liquefied natural gas storage tank and the hose. One or more valves may also be present in the line that connects the hose to the bulk liquefied natural gas storage tank. A second hose for recovering natural gas may also be in fluid communication with the condensing unit.

Other cryogenic fluids can be employed in addition to or in place of the liquid nitrogen and liquefied natural gas. For example, liquid air may be used in place of liquefied nitrogen.

Additional liquid nitrogen heat exchangers may be employed in the overall process. For example, a LIN condensing coil may be included inside the bulk LNG storage tank for vent control or an internal or external LIN/LNG heat exchanger may be used to control temperature in the bottom of the bulk storage tank.

The LIN condenser may be of any size or type as well as multiple units thereof. Natural gas vapor may be from other sources and along with the natural gas from the bulk storage tank may also be condensed in the condenser.

The pressure building apparatus and associated valving and controls may also be incorporated into the condenser to facilitate repressurization and condensate return to the bulk storage tank.

Numerous changes and modifications to the pipework, valving and controls are possible within the scope of the invention. Level detectors may be added, the particular return valve NRV3 referenced below may be replaced with a valve or a supplemental condensate return pump. Numerous changes to the sequence of operation, valve sequencing, etc. are also possible within the scope of the invention.

BRIEF DESCRIPTION OF THE DRAWINGS

The FIGURE is a schematic of a liquefied natural gas fueling system per the invention.

DETAILED DESCRIPTION OF THE INVENTION

Turning to the FIGURE, the inventive method of fueling and recovering vapor is shown. Bulk liquefied natural gas is stored in tank A typically at an elevated pressure of 12 to 15 barg. The LNG in the bulk storage tank will be used to fuel onboard vehicle storage tanks at the lower pressure of 3 to 10 barg. The fueling will occur through a single filing hose CO1 where vapor can be returned at the start of the process through the same hose used to supply LNG or a dual filling arrangement CO1 and CO2 where the vapor is returned through the separate hose CO2.

At the start of the process, the majority of the fueling equipment components such as valves, flow meters, etc. are warm. The flow meter designated FE1 is particularly required to be cooled down prior to fueling. The liquid nitrogen condenser C is used to facilitate cool down of the flowmeter FE1 and pipework without venting to the atmosphere.

Before the fueling begins, valve V2 is maintained in the closed position while valves V1 and V3 are opened. The LNG from the liquefied natural gas storage tank A will not flow through the systems because the components are all essentially at the same pressure. A pressure difference can be created by feeding liquid nitrogen from LIN storage tank B through line 4 to condenser C by opening valve V4. This will cause natural gas vapor to condense in the condenser C and a flow of LNG from the LNG bulk storage tank A will begin to facilitate cooldown of the piping and flow meter by flowing through line 1 and valve V1 to the flow meter FE1. The nitrogen from LIN tank B does not commingle with the LNG from bulk storage tank A as they are only in a heat communication relationship.

In a separate step that can occur either before or after the cooldown step, excess vapor in the onboard storage tank (not shown) may be recovered prior to fueling by attaching either the single hose CO1 or dual hose CO1 and CO2 fueling. Valve V1 will remain closed and valve V3 is opened. The onboard storage tank vapor is introduced into the LIN condenser C. If the one fueling hose CO1 is employed, the onboard storage tank vapor will pass through line 7, valve V2 would be closed, and the vapor would pass through line 8 and open return valve NRV1 to line 2 where it would pass through open valve V3 to line 3 and into the condenser C. When both fueling hoses CO1 and CO2 are employed, the vapor would pass through line 9 and open return valve NRV2 to line 2 and continue through open valve V3 to line 3 and into the condenser C.

As discussed above, the liquid nitrogen is introduced into the condenser C through line 4 from liquid nitrogen storage tank B. The cold liquid nitrogen will condense the vapor that has been recovered from the onboard storage tank through hose CO1 or CO2. The vapor will condense inside the condenser C and this process can continue until the onboard storage vessel is at a suitable pressure.

When the onboard storage vessel is at the appropriate suitable pressure, LNG fueling can proceed into the onboard storage tank. When filling of the onboard storage tank occurs, LNG from storage tank A will be fed through line 1 to open valve V1 through the flow meter FE1 Valve V3 is closed. The LNG will pass through open valve V2 through line 7 to the fueling hose CO1 which will provide for dispensing LNG into the onboard storage tank.

At the conclusion of fueling, valve V1 will be closed. The natural heat load from the ambient into the hoses, pipework and condenser will cause the collected liquid to partially vaporize and pressurize the pipework and the condenser chamber C (i.e., the natural gas side of the chamber). This effect will continue until the pressure in the condenser C is greater than the bulk LNG storage tank A pressure at which point the collected LNG condensate will return from the condenser to the bulk storage tank A through non-return valve NRV3.

While this invention has been described with respect to particular embodiments thereof, it is apparent that numerous other forms and modifications of the invention will be obvious to those skilled in the art. The appended claims in this invention generally should be construed to cover all such obvious forms and modifications which are within the true spirit and scope of the invention.

Having thus described the invention, what we claim is:

1. A method for fueling a vehicle comprising the steps:

a) Feeding a liquid cryogen into a condensing unit, thereby condensing natural gas present in the condensing unit wherein the condensing unit is in fluid communication with an onboard storage tank of the vehicle;

b) Creating a pressure differential between the onboard storage tank and a bulk liquefied natural gas storage tank of the fueling system;

c) Recovering natural gas vapor from an onboard storage tank of said vehicle and feeding said natural gas vapor to the condensing unit; and d) Feeding liquefied natural gas from the bulk liquefied natural gas storage tank of the fueling system to said onboard storage tank after a predetermined pressure is reached in the onboard storage tank.

2. The method as claimed in claim 1 wherein said liquid cryogen is liquid nitrogen.

3. The method as claimed in claim wherein said pressure differential allows liquefied natural gas to flow through said fueling system.

4. The method as claimed in claim 1 wherein said feed of liquefied natural gas into said fueling system cools components of said fueling system.

5. The method as claimed in claim 4 wherein said components of said fueling system are selected from the group consisting of valves, flow meters and piping.

6. The method as claimed in claim 1 wherein said condensed natural gas vapor is returned to a source of liquefied natural gas.

7. The method as claimed in claim 1 wherein said condensed natural gas vapor is returned to said source of liquefied natural gas when the pressure in said condensing unit is greater than the pressure of said liquefied natural gas source.

8. The method as claimed in claim 1 wherein said feeding of liquefied natural gas to said onboard storage tank and recovery of said natural gas vapor to said condensing unit is through one or more hoses.

* * * * *